US005950242A

United States Patent [19]

Mahoney

[11] Patent Number: 5,950,242

[45] Date of Patent: Sep. 14, 1999

[54] ATTACHMENT FOR CAP STRAPS

[76] Inventor: Kevin S. Mahoney, 810 Old Post Rd., Fairfield, Conn. 06430

[21] Appl. No.: 08/933,662

[22] Filed: Sep. 19, 1997

[51] Int. Cl.[6] ..... A42B 1/06

[52] U.S. Cl. ..... 2/209.13; 2/244; 2/172; 40/329; 40/672

[58] Field of Search ..... 2/209.13, 244, 2/172; 40/329, 124.09, 124.14, 124.16, 665, 672

[56] References Cited

U.S. PATENT DOCUMENTS

| | | | |
|---|---|---|---|
| 417,365 | 12/1889 | Parker . | |
| 441,805 | 12/1890 | Parker . | |
| 676,293 | 6/1901 | Wright . | |
| 847,799 | 3/1907 | Miller . | |
| 864,040 | 8/1907 | Sutton . | |
| 869,401 | 10/1907 | Wells . | |
| 1,237,662 | 8/1917 | Lawrence . | |
| 4,719,651 | 1/1988 | Tereshiniski | 2/197 |
| 4,914,843 | 4/1990 | Dewoskin | 40/665 |
| 5,003,640 | 4/1991 | Pizzacar | 2/199 |
| 5,499,402 | 3/1996 | Rose | 2/209.13 |
| 5,517,695 | 5/1996 | Murray | 2/195.1 |
| 5,519,891 | 5/1996 | Peters et al. | 2/181.4 |
| 5,546,605 | 8/1996 | Mallardi | 2/209.13 |
| 5,600,855 | 2/1997 | Ramirez | 2/209.13 |
| 5,632,047 | 5/1997 | Van Den Heuvel | 2/209.13 |

OTHER PUBLICATIONS

A photocopy of the device having the following indicia printed thereon: *KWWL7 Iowa's News Channel.* Due to the text printed on the device, applicant estimates that this device was in existence on or about Jul. 19, 1996.

*Primary Examiner*—Diana L. Oleksa
*Attorney, Agent, or Firm*—Raymond A. Nuzzo

[57] ABSTRACT

The present invention is directed to an attachment for use with adjusting straps on a cap comprising a sheet of flexible material having a first portion and a second portion contiguous with the first portion. The first portion and second portion each have a width and a length wherein the width of the first portion is greater than the width of the second portion and the length of the second portion is greater than the length of the first portion. The first portion has a widthwise slit having a perimetrical edge and an axis that is substantially perpendicular to the longitudinal axis of the sheet. The slit is sized for frictional insertion therethrough of the second portion. The second portion has a first end at the point of contiguity of the first and second portions and a second end opposite the first end. The second portion has an integrally formed engagement region in proximity to the point of contiguity of the first and second portions and adapted for engaging the perimetrical edge of the slit. The insertion of the second portion through the slit forms a tubular member comprised substantially of the first portion and sized for receiving the adjusting cap straps. The engagement of the engagement portion with the perimetrical edge of the slit prevents withdrawal of the second portion from the slit and effects a downward and substantially vertical orientation of the second portion as it extends from the slit when the second portion is inserted through the slit. The second portion has a surface intermediate the first and second ends of the second portion for displaying indicia, logos and trademarks.

16 Claims, 11 Drawing Sheets

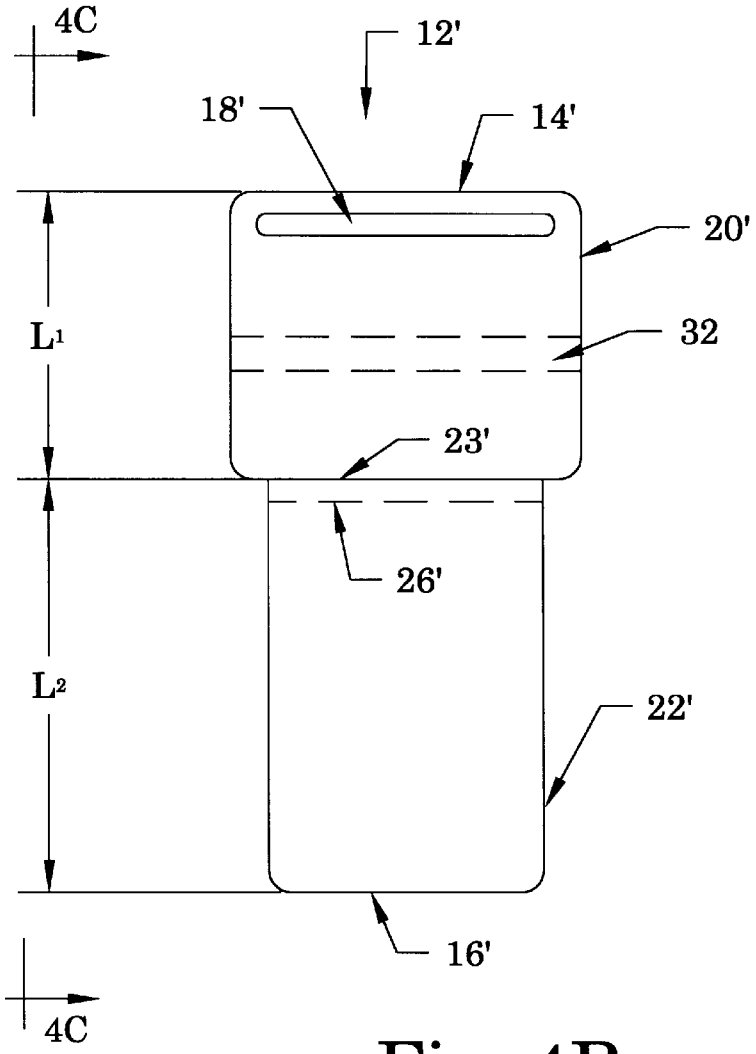
Fig. 4B
Fig. 4C
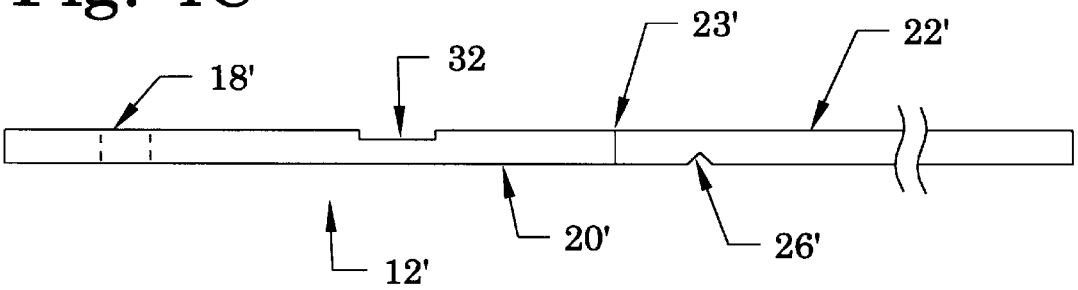

ATTACHMENT FOR CAP STRAPS

BACKGROUND OF THE INVENTION

COPYRIGHT NOTICE

©Copyright 1997, Kevin S. Mahoney. All rights reserved.

A portion of the disclosure of this patent document contains material that is subject to copyright protection. The copyright owner has no objection to the facsimile reproduction by anyone of the patent document or the patent disclosure, as it appears in the USPTO patent file or records, but otherwise reserves all copyright rights whatsoever.

1. Field of the Invention

The present invention relates to an attachment for use with interconnecting straps typically found on sports-type caps, clothing and other apparel.

2. Background of the Invention

Adjustable fastening straps are typically utilized with sports-type caps, clothing and other apparel wherein the straps fasten one portion of the apparel to another portion of the apparel. When used with sports-type caps such as baseball caps, the adjustable fastening straps enable the user to adjust the inner diameter of the cap to match the hat size of the wearer. Specifically, the adjustable fastening straps enable the user to adjust the size of the headband surrounding the fabric dome of the cap. The adjustable straps are typically fabricated from light, flexible materials such as plastic. Typically, one of the straps has a plurality of openings or apertures formed therethrough and the other strap has a corresponding plurality of small pegs or pins that are adapted to snap through the openings to hold the straps in adjusted position.

SUMMARY OF THE INVENTION

In one aspect, the present invention is directed to an attachment for use with adjusting straps on a cap comprising a sheet of flexible material having a first portion and a second portion contiguous with the first portion. The first portion and second portion each have a width and a length wherein the width of the first portion is greater than the width of the second portion and the length of the second portion is greater than the length of the first portion. The first portion has a widthwise slit having a perimetrical edge and an axis that is substantially perpendicular to the longitudinal axis of the sheet. The slit is sized for frictional insertion therethrough of the second portion. The second portion has a first end at the point of contiguity of the first and second portions and a second end opposite the first end. The second portion has an integrally formed engagement region in proximity to the point of contiguity of the first and second portions and adapted for engaging the perimetrical edge of the slit. The insertion of the second portion through the slit forms a tubular member comprised substantially of the first portion and is sized for receiving the adjusting cap straps. The engagement of the engagement portion with the perimetrical edge of the slit prevents withdrawal of the second portion from the slit and effects a downward and substantially vertical orientation of the second portion as it extends from the slit when the second portion is inserted through the slit. The second portion has a surface intermediate the first and second ends of the second portion for displaying indicia, advertisements, logos and trademarks.

BRIEF DESCRIPTION OF THE DRAWINGS

The features of the invention are believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 4B is a top plan view of a piece of flexible material prior to be folded to form the alternate attachment shown in FIG. 4A.

FIG. 4C is a view taken along line 4C—4C of FIG. 4B.

DETAILED DESCRIPTION OF THE INVENTION

In describing the preferred embodiments of the present invention, reference will be made herein to FIGS. 1–7 of the drawings in which like numerals refer to like features of the invention.

Figure 1:
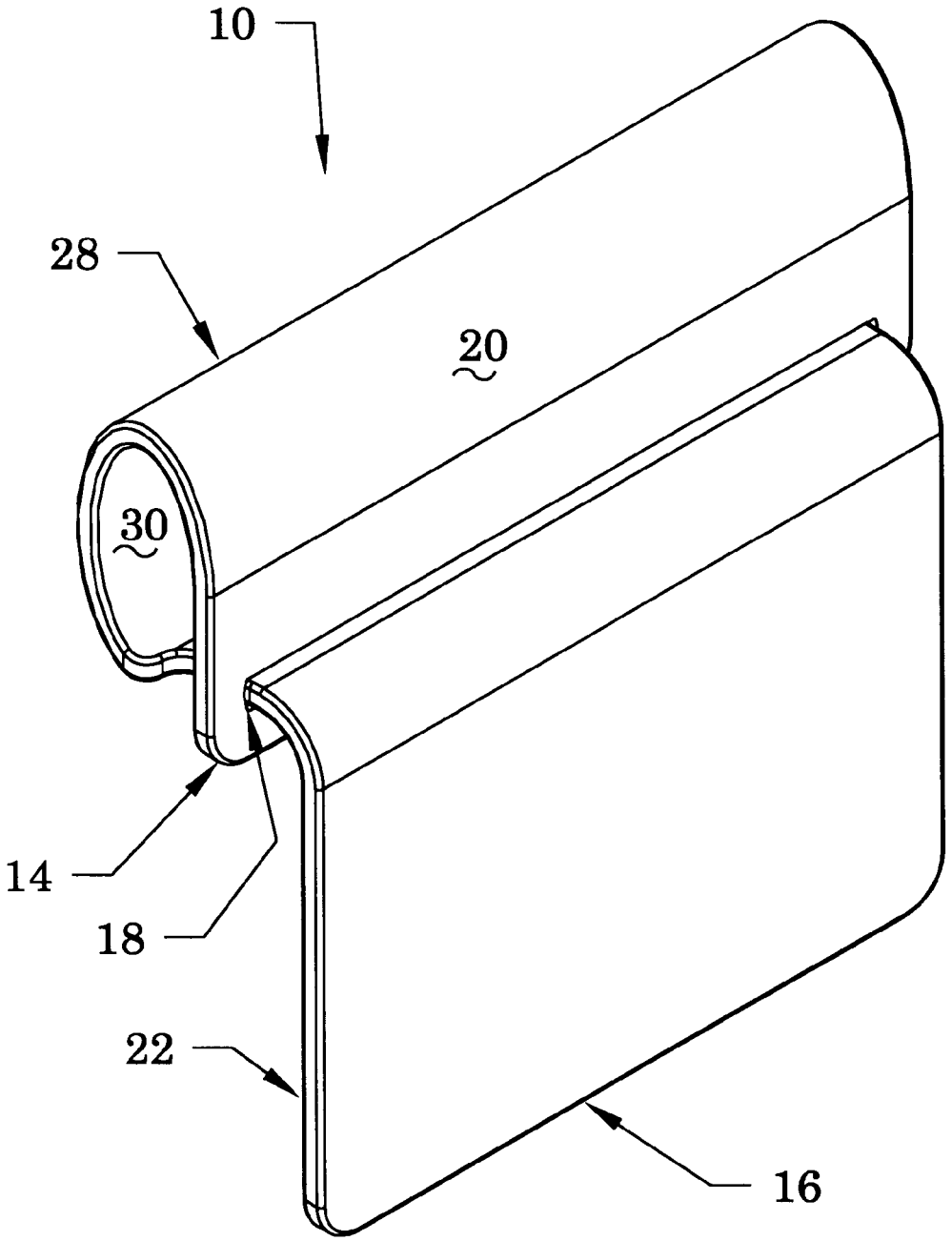
FIG. 1 is a front perspective view of the attachment of the present invention.
Figure 2:
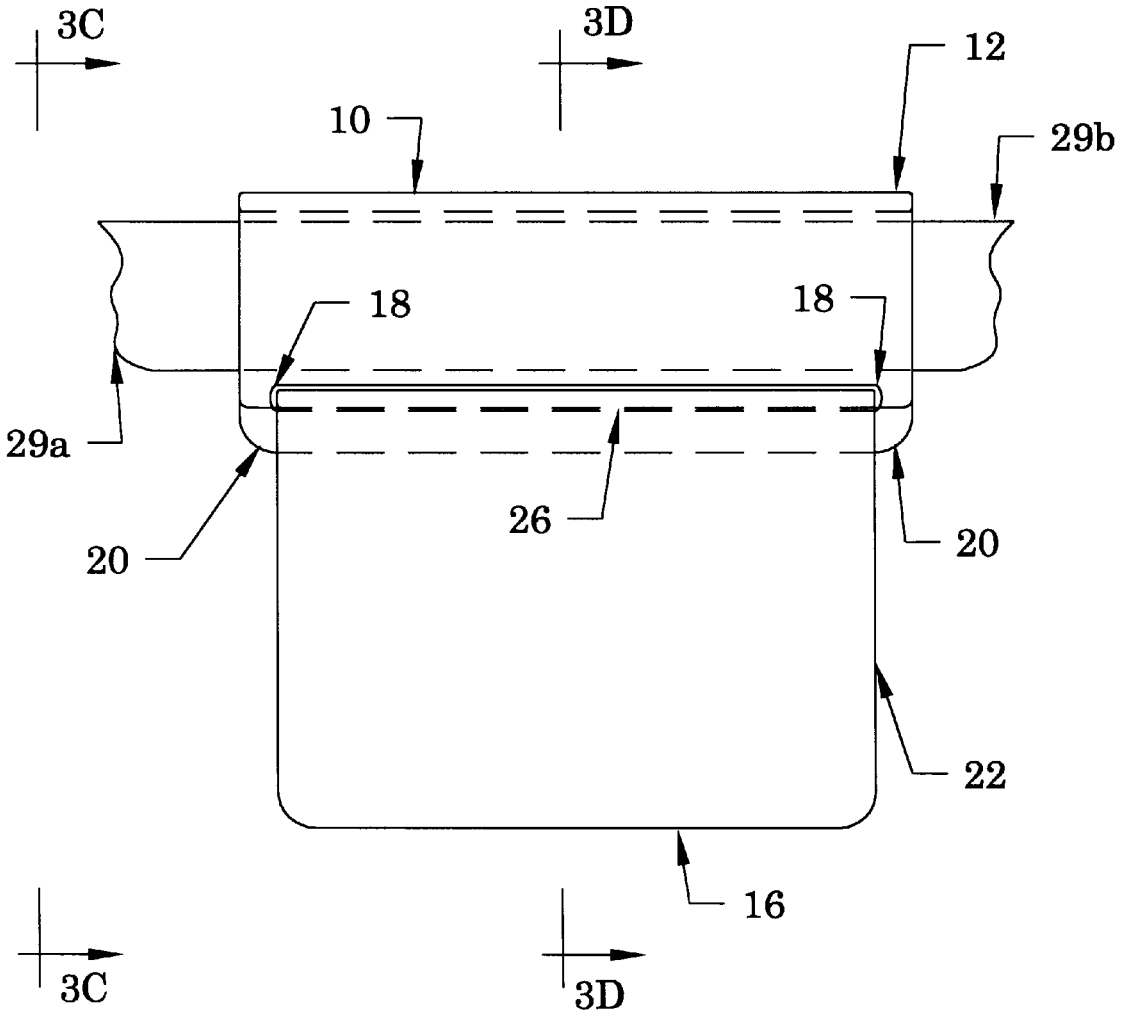
FIG. 2 is a front elevational view of the attachment of FIG. 1.
Figure 3A:
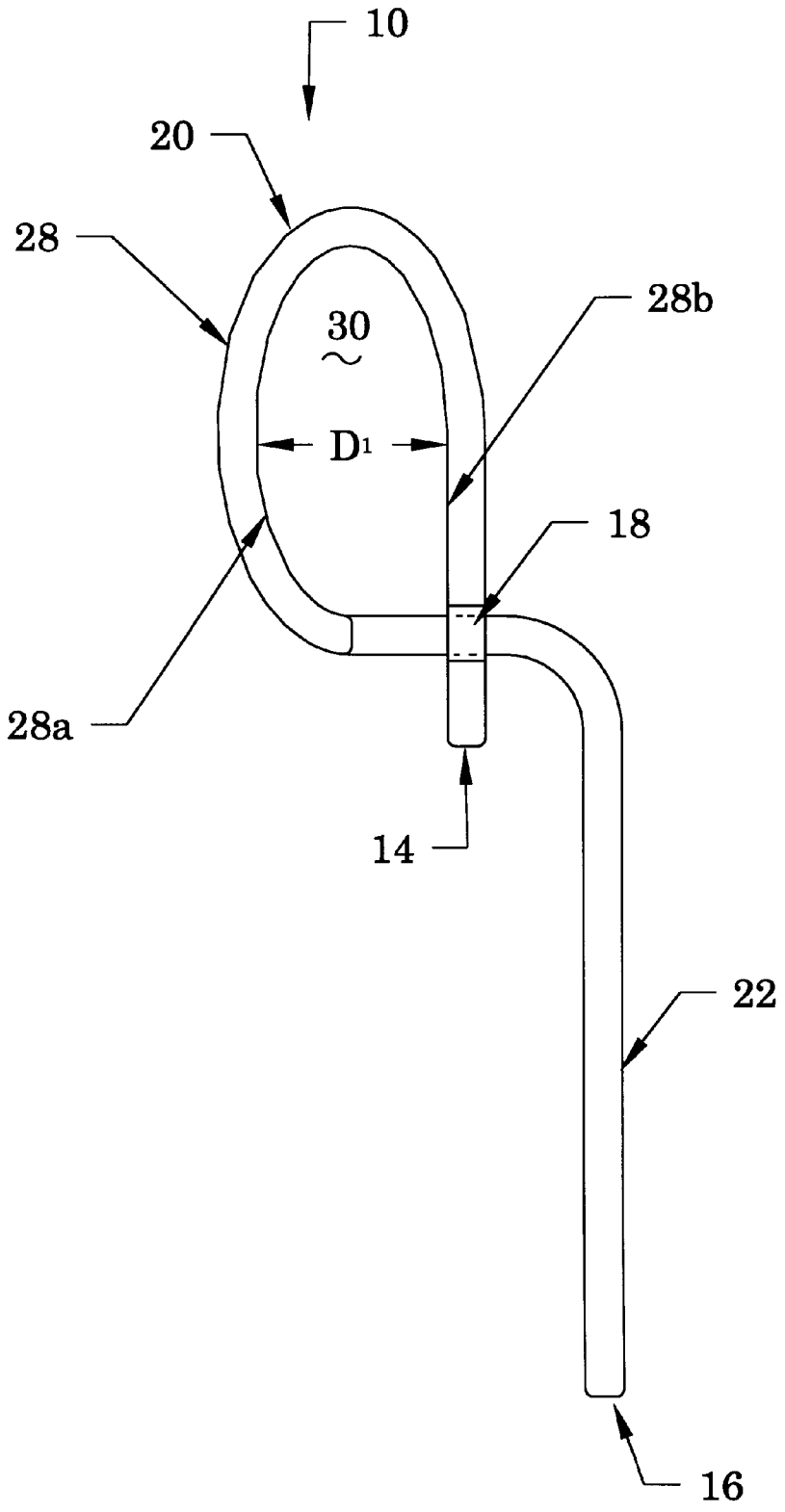
FIG. 3A is a side view of the attachment of FIG. 1

Referring to FIGS. 1, 2 and 3A, there is shown attachment 10 of the present invention. Attachment 10 is preferably formed from a single piece or sheet 12 of flexible material shown in FIG. 3B. Sheet 12 has ends 14, 16 and widthwise slot or slit 18 adjacent end 14. The axis of slot 18 is substantially perpendicular to longitudinal axis 13 of sheet 12. Slot 18 has perimetrical edge 19 which has lengthwise edges 19*a* and 19*b*. Slot 18 is also designated by the pair of dotted lines in FIGS. 3A, 3C and 4A. Sheet 12 comprises portion 20 and portion 22 which is contiguous with portion 20. Portion 20 has a width W1, a length L1 and edges 21*a*, 21*b*. Portion 22 has a width W2 and a length L2. Width W1 is greater than width W2. In a preferred embodiment, length L2 is greater than length L1. Portion 22 has one end, defined by end 16, and end 23 that is at the point of contiguity of portions 20 and 22. Slot 18 is sized to receive portion 22 and to provide a frictional relationship between portion 22 and perimetrical edge 19 of slot 18. Portion 22 has engagement region 26 formed in portion 22 adjacent end 23. As shown in FIG. 2, engagement region 26 is represented by a dotted line. However, engagement region 26 is actually on the reverse side of portion 22 as shown in FIG. 3C, 3D and 4C. The purpose of region 26 will be discussed below.

Figure 3B:
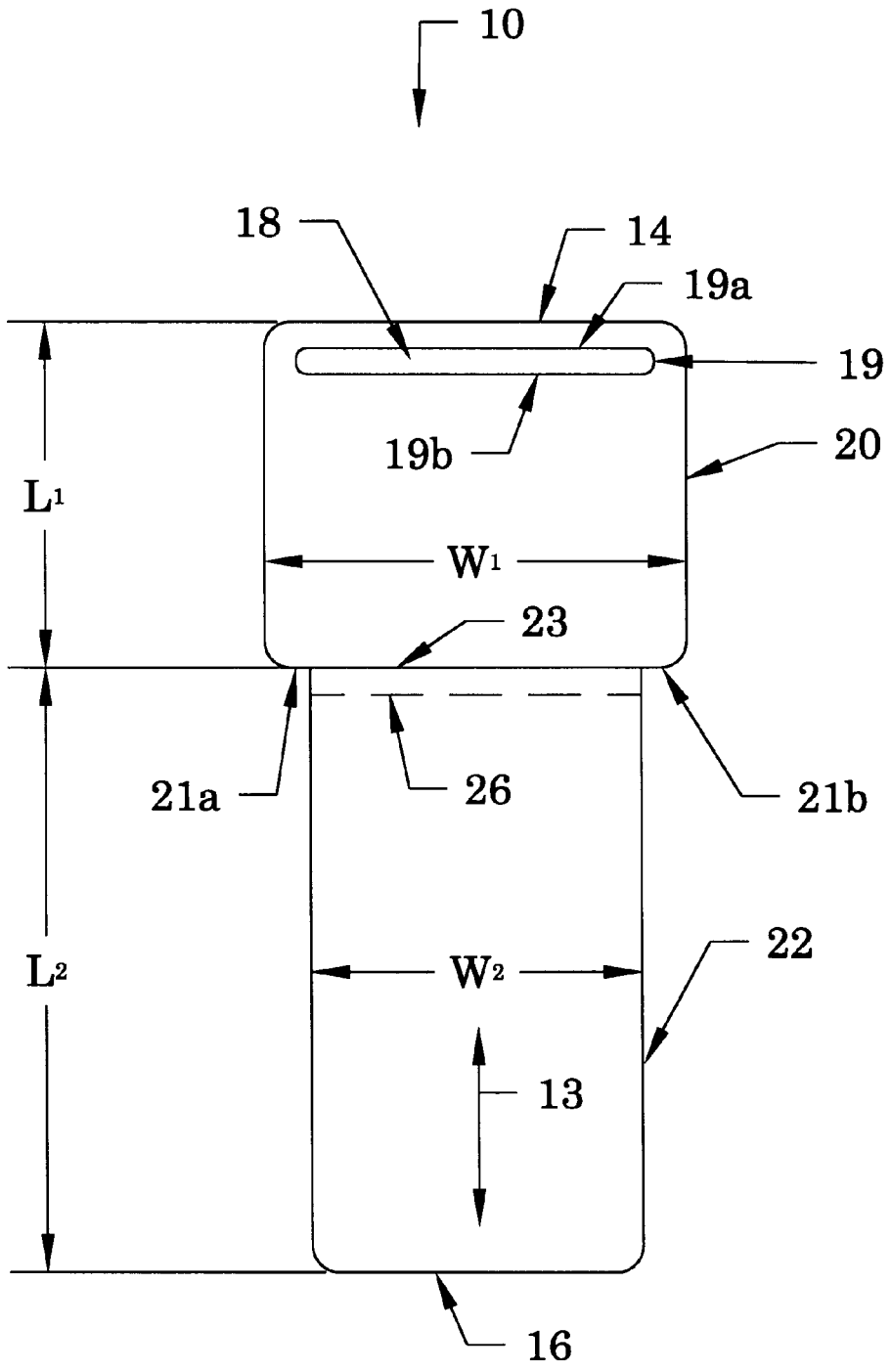
FIG. 3B is a top plan view of a piece of flexible material prior to being folded to form the attachment of FIG. 1.
Figure 3C:
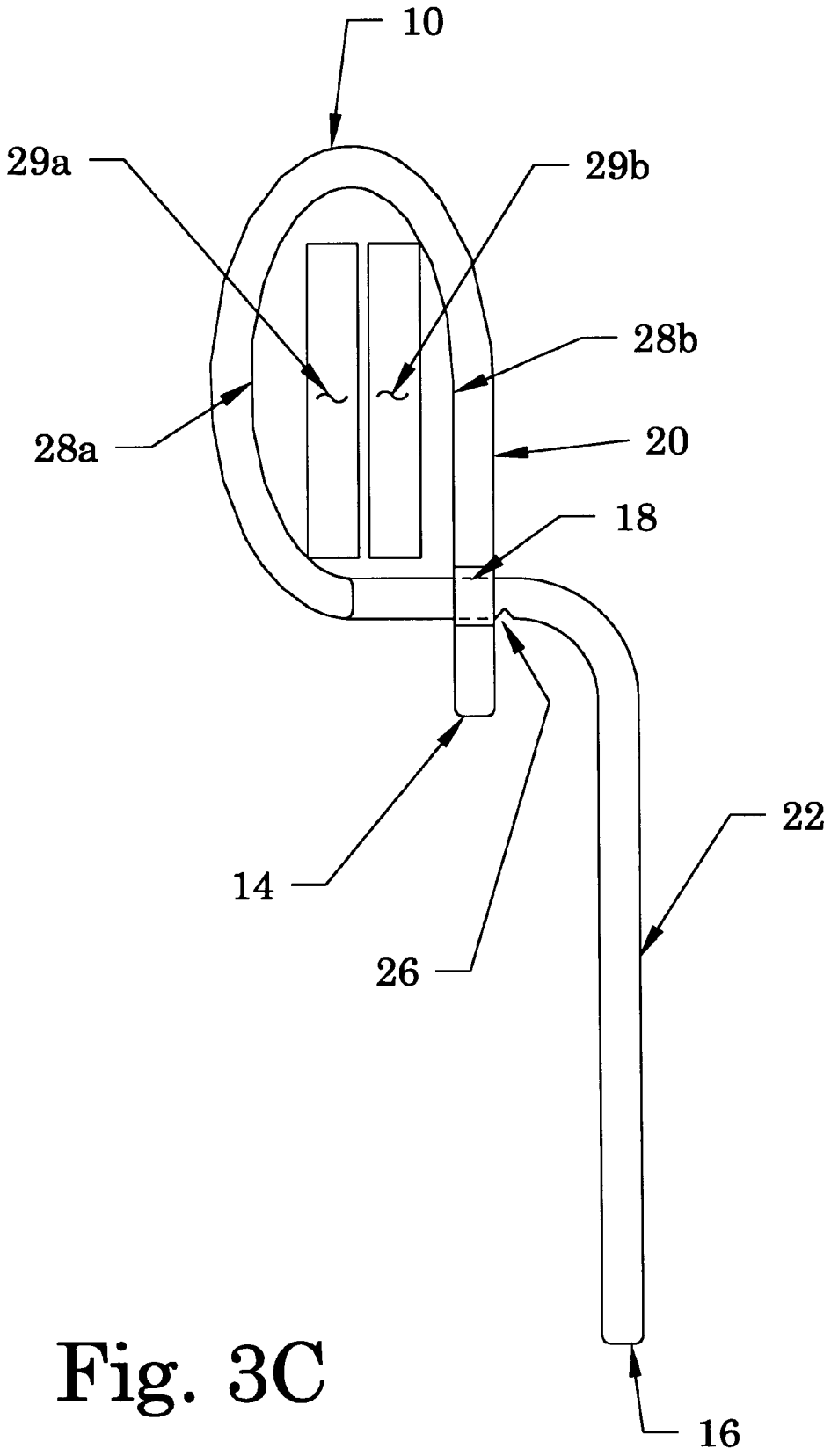
FIG. 3C is an end view taken along 3C—3C of FIG. 2.
Figure 3D:
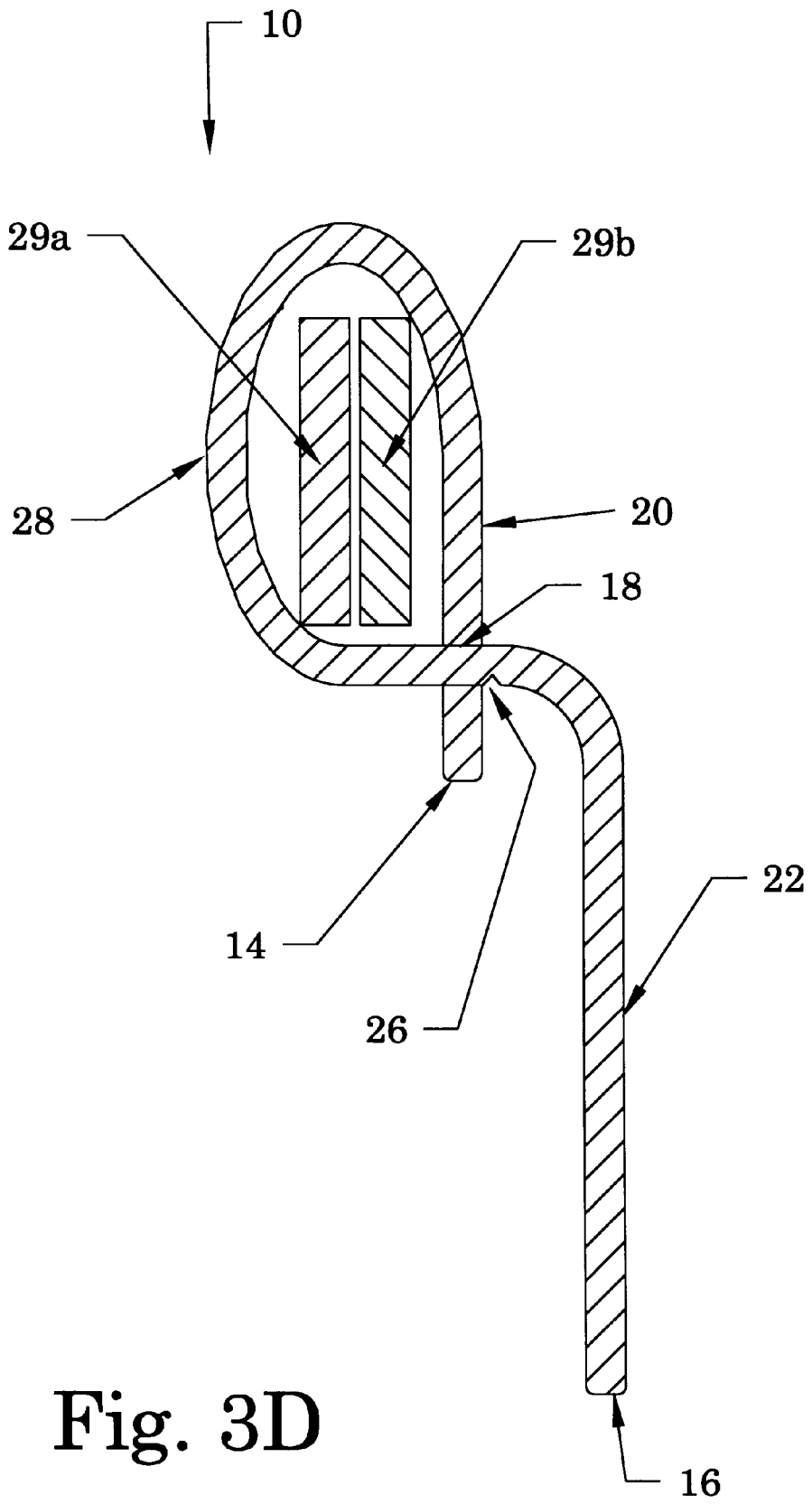
FIG. 3D is a view taken along line 3D—3D of FIG. 2.
Figure 4A:
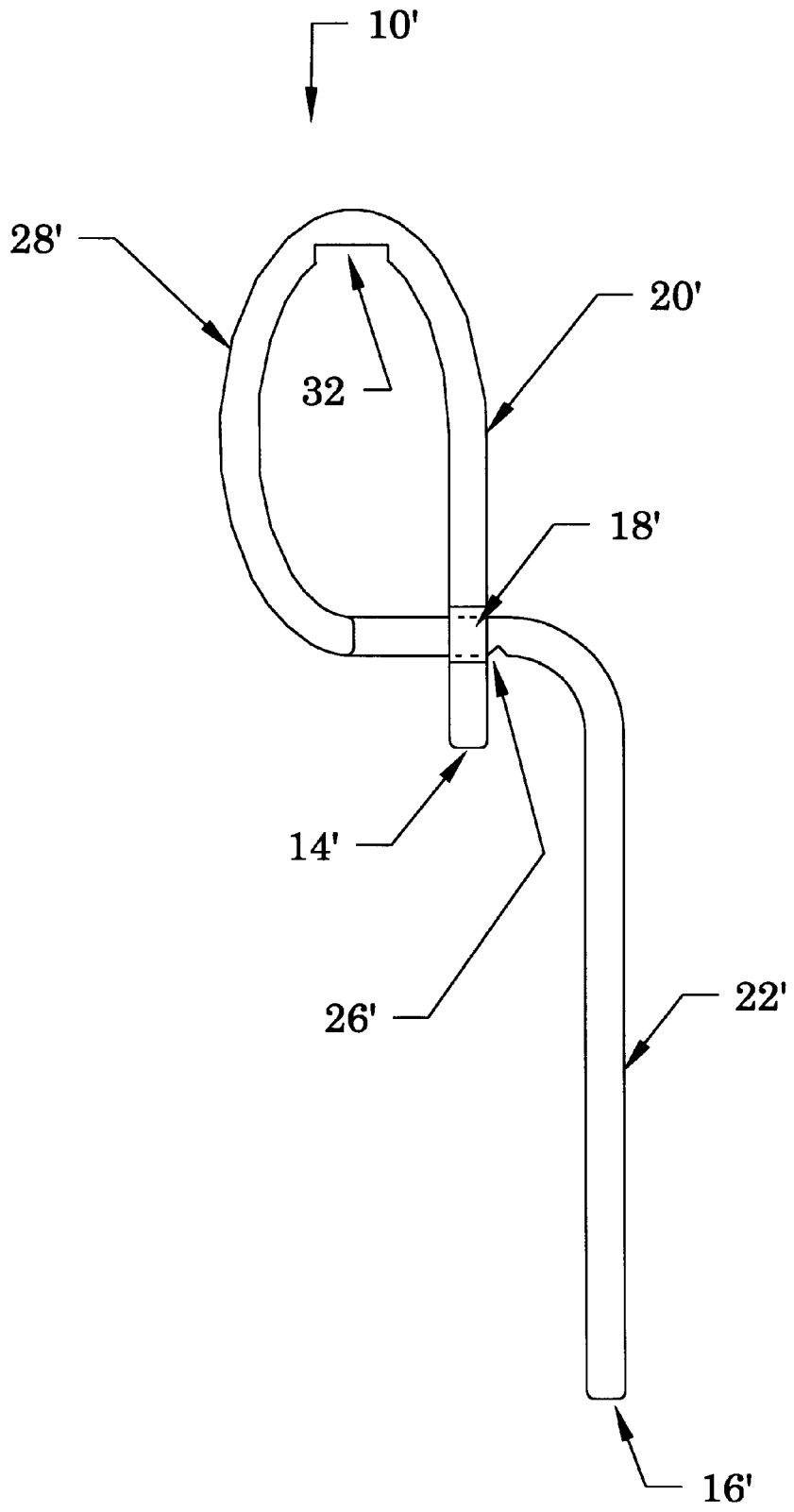
FIG. 4A is a view, similar to FIG. 3A, of an alternate embodiment of the attachment of the present invention.

Referring to FIG. 3A, 3B and 3D, in order to form attachment 10 (as shown in FIGS. 1, 2, and 3A), end 16 is inserted through slot 18 and pulled through slot 18 until engagement region 26 engages lengthwise edge 19*a* of slot 18. Engagement region 26 prevents portion 22 from withdrawing from or slipping back through slot 18 when portion 22 is completely inserted through slot 18. Engagement region 26 also allows portion 22 to protrude or extend from slot 18 in a substantially vertical orientation. Preferably, engagement region 26 is formed by a notch, crease or scored region. However, engagement region 26 may also be formed by other suitable methods. As a result of inserting portion 22 through slot 18, a generally tubular formation 28 is created. Tubular portion 28 defines interior region 30 sized for receiving adjustable fastening straps 29*a*, 29*b* of a sports-type cap, e.g. baseball cap. It is to be understood that sheet 12 can be configured so that portions 20 and 22 have respective lengths that will provide a tubular portion 28 of sufficient size to allow interior region 30 to receive or be wrapped around handles of brief cases, luggage, women's' pocketbooks and other apparel or accessories.

FIG. 3A shows attachment 10 prior to being mounted to the adjustable fastening cap straps. In a preferred embodiment, portion 20 has a length L1 that provides a close and tight-fitting relationship between interior wall portions 28*a*, 28*b* and adjustable fastening straps 29*a* and 29*b* (see FIG. 3C). Such a configuration ensures that attachment 10 does not rotate about the adjustable cap straps 29*a* and 29*b* and that portion 22, as it extends from slot 18, is maintained in a substantially vertical orientation. As stated above, engagement region 26 causes portion 22 to protrude or extend from slot 18 in a substantially vertical fashion. It is highly preferred that portion 22 be maintained in a substantially vertical orientation so as to enable portion 22 to function as a sun shield or surface or area for advertisement, logos, trademarks, cartoons, etc. Advertisements, trademarks, logos and other indicia may also be placed upon the surface of tubular member or portion 28.

An advantage of attachment 10 is that it can be mounted to straps 29*a* and 29*b* by either of two (2) methods. In the first method: (i) cap straps 29*a*, 29*b* are left connected, (ii) sheet 12 is wrapped around straps 29*a*, 29*b*, and (iii) end 16 is inserted through slot 18 as discussed above. In the second method: (i) cap straps 29*a*, 29*b* are disconnected, (ii) attachment 10 is then formed as discussed above, (iii) straps 29*a*, 29*b* are inserted through region 30, (iv) the straps are aligned to the correct configuration, and (vi) the user squeezes attachment 10 so as to cause the pins of one strap to enter the openings or apertures of the other strap.

Referring to FIG. 4A, an alternate embodiment of the attachment of the present invention is shown. Attachment 10' is formed from the sheet 12' shown in FIG. 4B. Sheet 12' is similar in construction to sheet 12. Sheet 12' has ends 14', 16' and portions has slot or slit 18' which functions in the same manner as slot 18 in sheet 12. Engagement region 26' functions in the same manner as region 26 (see FIG. 3B) and is located adjacent end 23'. When end 22' is inserted through slot or slit 18', tubular portion or member 28' is formed in a manner substantially identical to the formation of tubular member or portion 28 (see FIG. 3A). Sheet 12' further includes engagement region 32. Engagement regions 26' and 32 may be configured as notches, creases or scored regions. FIG. 4C shows a side view of sheet 12' wherein regions 26' and 32 are configured as notches. FIG. 4A shows attachment 10' prior to being mounted to the adjustable fastening straps of a cap. Engagement region 32 is sized to receive the top edges of cap straps 29*a* and 29*b*. Thus, engagement regions 26 and 32 and the preferred length L1 of portion 20' ensure that: (i) portion 22' does not withdraw from or move back through slot 18', (ii) attachment 10' does not rotate about the adjustable fastening straps and (iii) portion 22' extends from slot 18' in a substantially vertical orientation.

Figure 5:
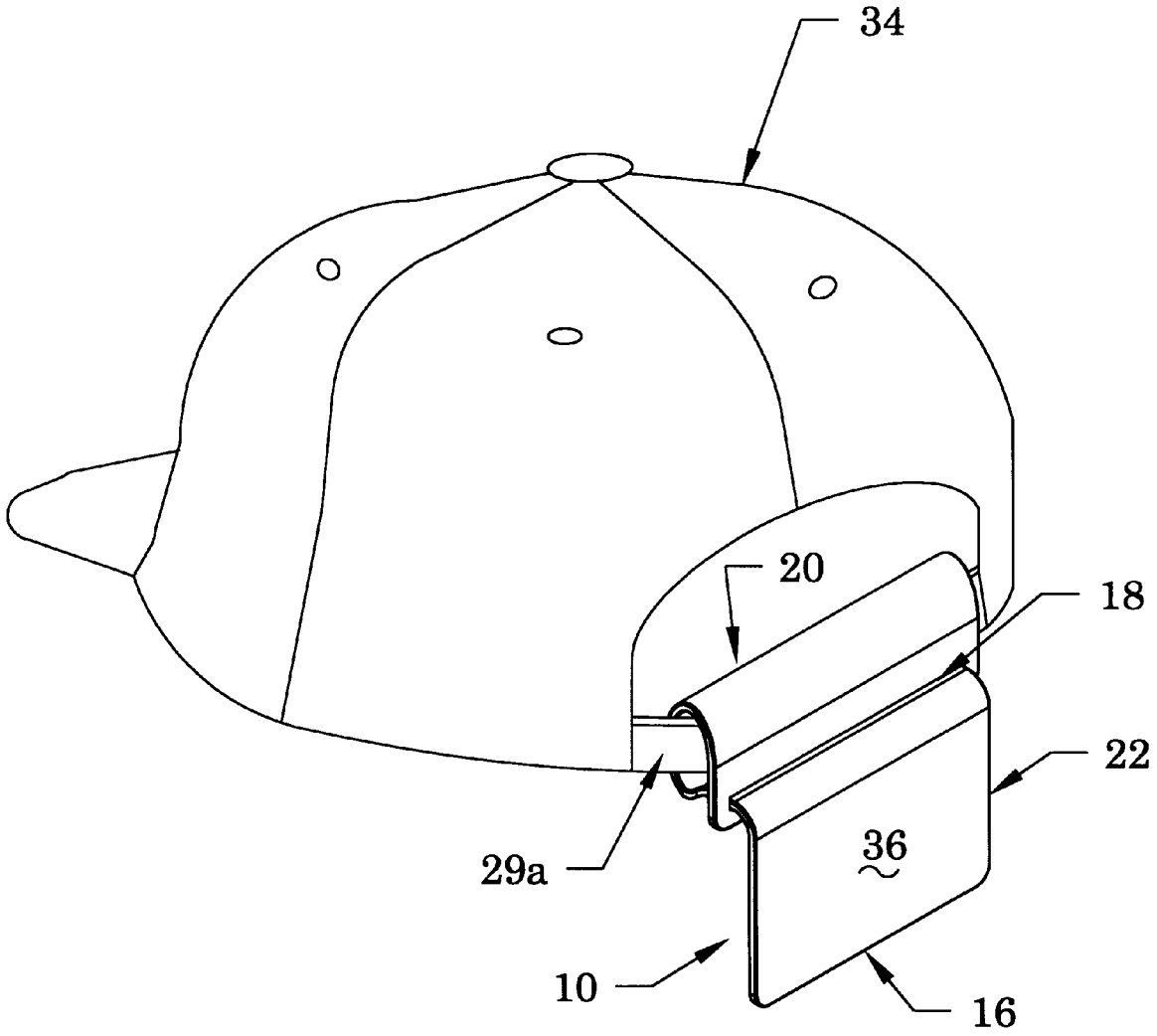
FIG. 5 is a rear perspective view of a sports cap and the attachment of the present invention attached to adjustable fastening straps of the cap.

Referring to FIG. 5, attachment 10 of the present invention is shown mounted to cap straps 29*a* and 29*b* (only strap 29*a* is visible) of cap 34. Portion 22 of attachment 10 hangs downward in a substantially vertical orientation thereby allowing planar surface 36 of portion 22 to function as a sun shield or a surface for advertisement, logos, trademarks, cartoons, etc. The length L2 of portion 22 can be varied depending on the intended function of portion 22. It is to be understood that the foregoing discussion of attachment 10 as mounted to cap 34 is also applicable to attachment 10'.

Figure 6:
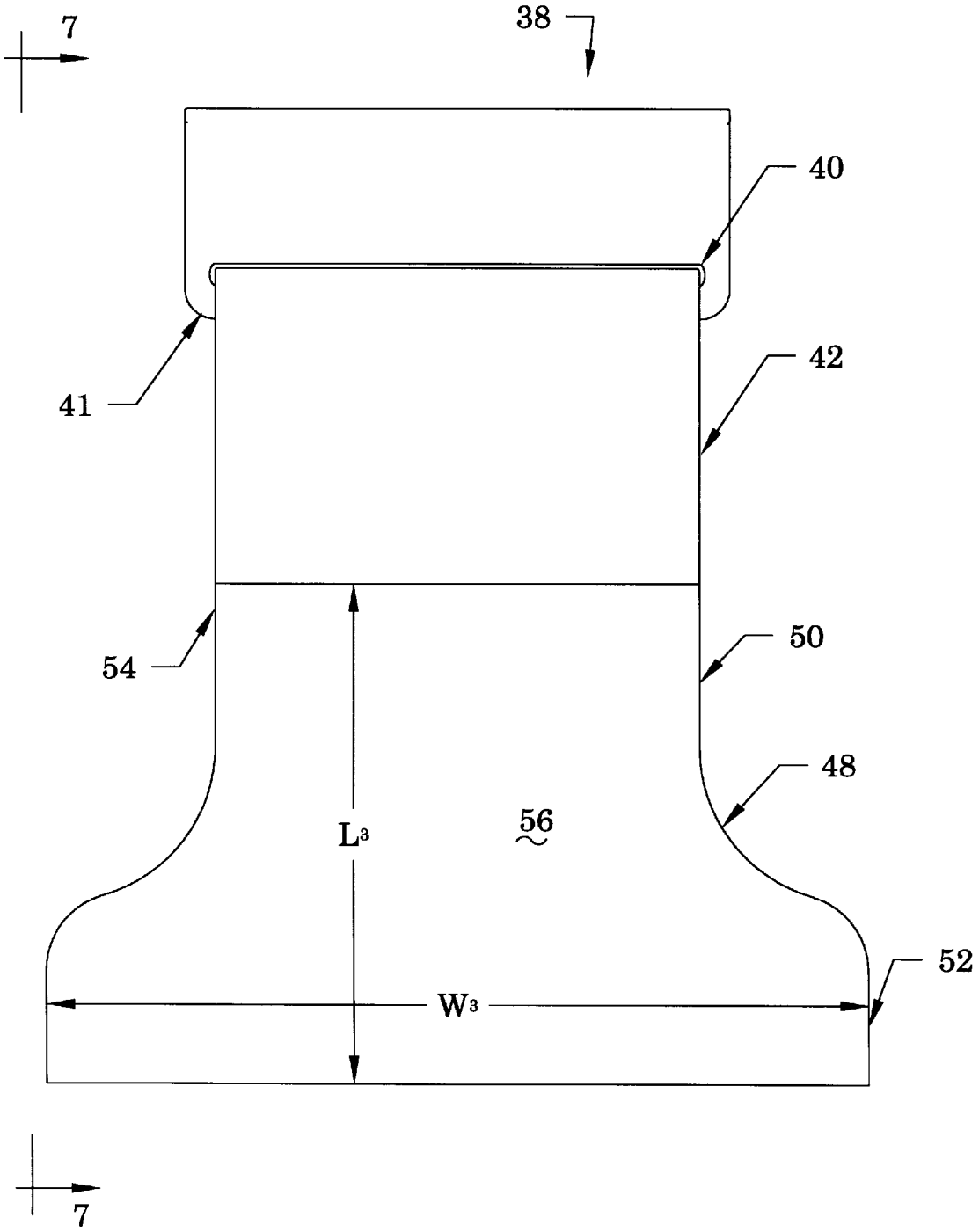
FIG. 6 is a front elevational view of a further embodiment of the attachment of the present invention.
Figure 7:
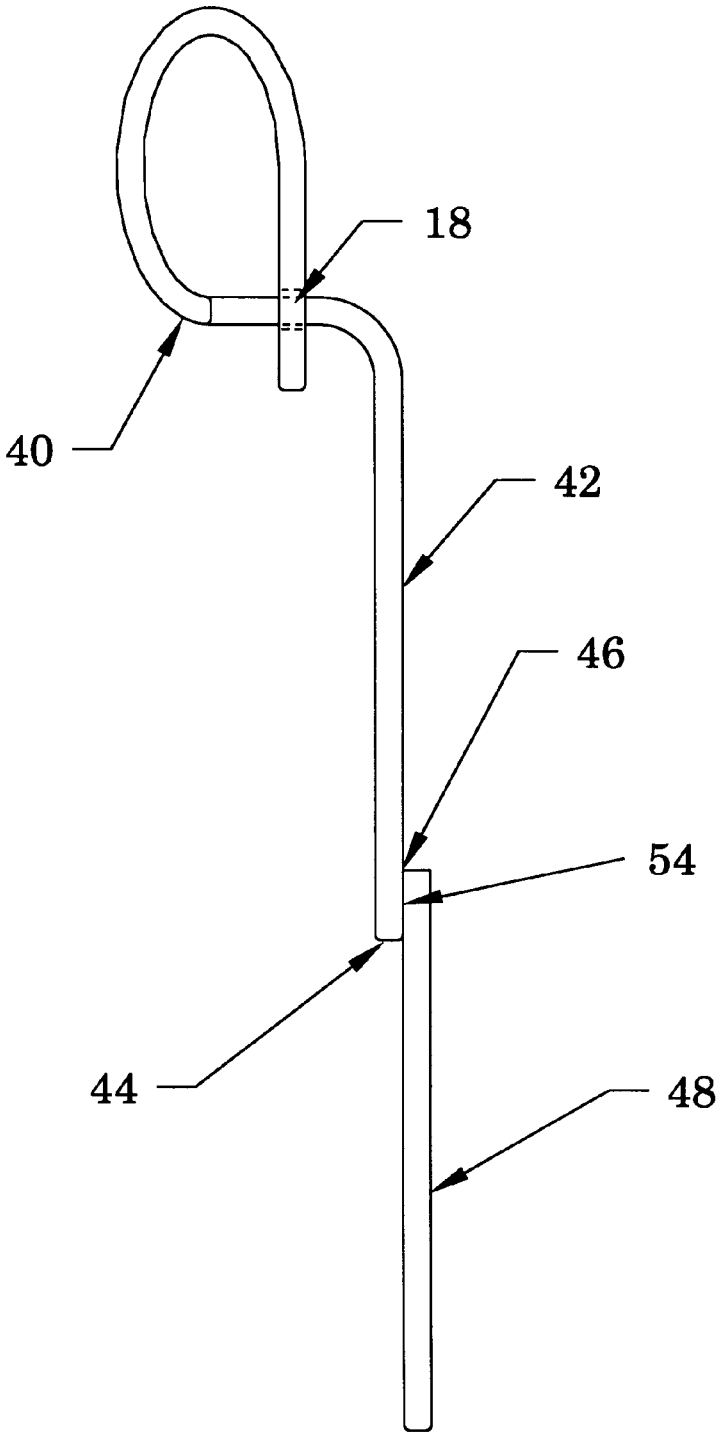
FIG. 7 is a view taken along line 7—7 of FIG. 6.

Referring to FIGS. 6 and 7, a further embodiment of the attachment of the present invention is shown. Attachment 38 is generally the same in construction as attachment 10 (see FIG. 3A) or attachment 10' (see FIG. 4A). Attachment 38 has slot 40 and portions 41 and 42. Slot 40 is substantially identical to slot 18 or 18'. Portion 41 is generally the same as portions 20 or 20'. Portion 42 is generally the same as portions 22 or 22'. Portion 42 has end 44 (see FIG. 7) and further includes region 46 adjacent end 44. Member 48 is attached to portion 42 at region 46. Member 48 has upper and lower portions 50 and 52, respectively. Member 48 has a length L3 that is substantially greater than L1 and L2 (see FIG. 3B). Portion 50 has a width that is substantially the same as width W2. Portion 52 has a width W3 that is substantially larger than width W1 and width W2. In a preferred embodiment, member 48 is substantially planar.

Member 48 can be attached to region 46 by any one of a variety of fastening techniques employing complimentary fastening portions. For example, a Velcro™ fastener can be used to attach member 48 to region 46. Another complimentary fastener that can be used comprises complimentary snaps (i.e. male and female snaps). The portion of the complimentary fastener that is attached to region 46 must be sized to permit insertion through slot 40. The other complimentary fastener portion is attached to upper periphery 54 of portion 50 (see FIG. 7).

Member 48 provides surface 56 that is substantially larger than surface 36 of portion 22 (see FIG. 5). Member 48 can function as a sun shield and can be sized to cover specific portions of the back of the wearer, e.g. back of the neck, shoulders, mid-back, etc. Member 48 can also function as a surface for displaying advertisements, logos, trademarks, etc. as stated above.

Attachment 10, 10' and 38 of the present invention are preferably made from flexible material such as foams, rubbers, woven fabrics, flexible plastics as well as combinations and laminates of such materials. Although member 48 may be made from the same materials, it is preferable that member 48 be fabricated from materials that are suitable for clothing, e.g. cotton, polyester, nylon, leather, etc.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An attachment for use with adjusting straps on a cap comprising a sheet of flexible material having a first portion and a second portion contiguous with the first portion, the first portion and second portion each having a width and a length wherein the width of the first portion is greater than the width of the second portion and the length of the second portion is greater than the length of the first portion, the first portion having a widthwise slit having a perimetrical edge and an axis that is substantially perpendicular to the longitudinal axis of the sheet, the slit being sized for frictional insertion therethrough of the second portion, the second portion having a first end at a point of contiguity of the first and second portions and a second end opposite the first end, the second portion having a scored region formed therein that is in proximity to the point of contiguity of the first and second portions and adapted for engaging the perimetrical edge of the slit, whereby the insertion of the second portion through the slit forms a tubular member comprised substantially of the first portion and sized for receiving adjusting cap straps on a cap, whereby the engagement of the scored region with the perimetrical edge of the slit prevents withdrawal of the second portion from the slit and effects a downward and substantially vertical orientation of the second portion as it extends from the slit when the second portion is inserted through the slit, the second portion having a surface intermediate the first and second ends of the second portion for displaying indicia, logos and trademarks.

2. The attachment according to claim 1 wherein the first portion has a surface surrounding the slit, the first portion having a pair of end portions adjacent the point of contiguity of the first and second portions and located on either side of the second portion, the end portions contacting the surface of the first portion when the second portion is completely inserted through the slit.

3. The attachment according to claim 1 wherein the first portion includes an integrally formed engagement region adapted for engaging a portion of the adjusting cap straps to prevent movement of the attachment when mounted to the adjusting cap straps.

4. The attachment according to claim 3 wherein the first portion has a first side and a second side and the second portion has a first side and a second side substantially coplanar with the first and second sides, receptively, of the first portion, whereby the engagement region is formed on the first side of the first portion and the scored region is formed on the second side of the second portion.

5. The attachment according to claim 3 wherein the engagement region comprises a crease.

6. The attachment according to claim 3 wherein the engagement region comprises a notch.

7. The attachment according claims further comprising:

a sun shielding member for shielding a wearer's back from the rays of the sun, the sun shielding member comprising a sheet of flexible material having a rear side for facing a wearer and a front side opposite the rear side; and a fastener for removably attaching the sun shielding member to the second end of the second portion, the fastener comprising a pair of complementary portions adapted for interconnection to one another, one complementary portion being attached to the sun shielding member, the other complementary portion being attached to the second end of the second portion.

8. The attachment according claim 7 wherein the sun shielding member is substantially flat and has a surface area sufficient in size to substantially shield a user's neck and shoulders from the rays of the sun, the front side of the sun shielding member providing a surface upon which may be placed indicia.

9. The attachment according claim 1 wherein the sheet of flexible material is fabricated from foam rubber.

10. The attachment according claim 1 wherein the sheet of flexible material is fabricated from flexible plastic.

11. A combination cap and attachment for use with the cap comprising:

a cap having a fabric dome;

a headband surrounding the dome;

a pair of straps at the back of the cap for adjusting the size of the headband, the dome having an opening above the straps; and an attachment removably attached to the cap straps comprising:

a sheet of flexible material having a first portion wrapped around the cap straps in a close-fitting relationship and a second portion contiguous with the first portion and extending downward in a substantially vertical orientation, the first and second portions each having a width and length wherein the width of the first portion is greater than the width of the second portion and the length of the second portion is greater than the length of the first portion, the first portion having a widthwise slit having a perinetrical edge and an axis that is substantially perpendicular to the longitudinal axis of the sheet, the second portion having a first end at a point of contiguity of the first and second portions and a second end opposite the first end, the second portion having an integrally formed first engagement region adjacent the first end of the second portion, the second portion being frictionally inserted through the slit such that the first engagement region engages the perimetrical edge of the slit and the first portion is wrapped around the adjusting cap straps, the engagement of the first engagement ion with the perimetrical edge of the slit preventing the second portion from withdrawing through the slit and effecting a substantially downward and vertical orientation of the second portion, the second portion having a surface intermediate the first and second ends for displaying indicia, logos or trademarks.

12. The combination cap and attachment according to claim 11 wherein the first portion includes a second integrally formed engagement region adapted for engaging a portion of the adjusting cap straps to prevent movement of the attachment when mounted to the adjusting cap straps.

13. The combination cap and attachment according to claim 12 wherein the first portion has a first side and a second side and the second portion has a first side and a second side substantially coplanar with the first and second sides, respectively, of the first portion, the second engagement region being formed on the first side of the first portion and the first engagement region being formed on the second side of the second portion.

14. The cap and attachment combination according to claim 13 wherein the first engagement region comprises a crease formed in the second side of the second portion and the second engagement region comprises a crease formed in the first side of the first portion.

15. The cap and attachment combination according to claim 13 wherein the first engagement region comprises a scored region formed in the second side of the second portion and the second engagement region comprises a scored region formed in the first side of the first portion.

16. An attachment for use with adjusting straps on a cap comprising a sheet of flexible material having a first portion and a second portion contiguous with the first portion, the first portion and second portion each having a width and a length wherein the width of the first portion is greater than the width of the second portion and the length of the second portion is greater tan the length of the first portion, the first portion having a widthwise slit having a perimetrical edge and an axis that is substantially perpendicular to the longitudinataxis of the sheet, the slit being sized for frictional insertion therethrough of the second portion, the second portion having a first end at a point of contiguity of the first and second portions and a second end opposite the first end, the second portion having a crease formed therein that is in proximity to the point of contiguity of the first and second portions and adapted for engaging the perimetrical edge of the slit, whereby the insertion of the second portion through the slit forms a tubular member comprised substantially of the first portion and sized for receiving adjusting cap straps on a cap, whereby the engagement of the crease with the perimetrical edge of the slit prevents withdrawal of the second portion from the slit and effects a downward and substantially vertical orientation of the second portion as it extends from the slit when the second portion is inserted through the slit, the second portion having a surface intermediate the first and second ends of the second portion for displaying indicia, logos and trademarks.

* * * * *